US008210195B2

(12) United States Patent
Quintana

(10) Patent No.: US 8,210,195 B2
(45) Date of Patent: Jul. 3, 2012

(54) FAUCET ASSEMBLY SECURING METHOD

(76) Inventor: Juan Quintana, Whittier, CA (US)

( * ) Notice: Subject to any disclaimer, the term of this patent is extended or adjusted under 35 U.S.C. 154(b) by 284 days.

(21) Appl. No.: 12/748,162

(22) Filed: Mar. 26, 2010

(65) Prior Publication Data

US 2011/0232777 A1 Sep. 29, 2011

(51) Int. Cl.
*F16L 5/00* (2006.01)

(52) U.S. Cl. ..... 137/15.01; 4/675; 4/695; 4/696; 137/315.12; 137/359; 137/801

(58) Field of Classification Search ..... 137/801, 137/606, 359, 360, 15.01, 15.18, 15.21, 315.12; 4/675, 676, 677, 678, 695, 696
See application file for complete search history.

(56) References Cited

U.S. PATENT DOCUMENTS

| | | | | |
|---|---|---|---|---|
| 1,740,156 | A | 12/1929 | Crane et al. | |
| 2,075,714 | A | 3/1937 | Hamill | |
| 2,468,315 | A | 2/1946 | Wagner | |
| 6,385,798 | B1 | 5/2002 | Burns et al. | |
| 6,405,749 | B1 | 6/2002 | Bloom et al. | |
| 6,421,849 | B1 | 7/2002 | Gray | |
| 6,631,730 | B1 * | 10/2003 | Bloom et al. | 137/359 |
| 6,868,590 | B2 | 3/2005 | Bentrim | |
| 7,162,755 | B2 * | 1/2007 | Mintz et al. | 4/695 |
| 7,244,085 | B2 | 7/2007 | Dobson et al. | |
| 2009/0100595 | A1 * | 4/2009 | Kozacki | 4/695 |

* cited by examiner

*Primary Examiner* — Craig Schneider
*Assistant Examiner* — Ian Paquette
(74) *Attorney, Agent, or Firm* — Kenneth L. Green

(57) ABSTRACT

A method for securing a faucet assembly to a counter top. The faucet assembly has downwardly depending threaded inlets for the hot and cold water. Flexible water hoses are secured to the hot and cold water under sink valves and the upper ends of the flexible hoses are extended through a hot water opening and a cold water opening in the counter top. Hollow cylinder cold flexible polymeric sleeves are pressed over the hot and cold water threaded inlet nipples. The assembly is then pushed down over the counter top so that the flexible sleeves form a tight frictional fit in the counter top openings.

6 Claims, 2 Drawing Sheets

FAUCET ASSEMBLY SECURING METHOD

FIELD OF THE INVENTION

The present invention relates to plumbing fixtures such as used in connection with kitchen and bathroom faucets. Typically, the bathroom faucet assembly is placed over two openings in a counter top so that hot and a cold water threaded inlet nipples extend below the bottom surface of the counter top. A nut is secured on the threaded nipples below the counter top openings to hold a faucet assembly in place.

U.S. Pat. No. 1,740,156 shows a rubber expansion packing 35 within an opening of a faucet housing. The packing is secured in place by tightening a nut 38 to expand the packing.

The desire to eliminate having to reach under a counter top to secure a faucet assembly in place has been approached in U.S. Pat. No. 6,385,798. A sleeve is threaded on an inlet nipple and passed through the opening in a counter top. The collar is screwed upwardly so that the sleeve 26 expands below the opening holding the plumbing picture in place. This device utilizes a plastic fitting of questionable life. The device showing U.S. Pat. No. 1,740,156 requires tightening a nut below the opening.

There is thus a need for a simple method for securing a faucet assembly to a counter top which does not require a faucet assembly being tightened under the countertop by reaching under the countertop.

BRIEF SUMMARY OF THE INVENTION

The present invention is for a method for securing a faucet assembly to a countertop. The faucet assembly has a faucet base supporting hot and cold water valves and a spigot. The hot and cold water faucet valves have downwardly extending threaded inlet nipples and the countertop has a pair of openings through which the nipples pass. A flexible hose is connected to each of the hot and cold water under sink valves and the upper end of the flexible hoses are extended through the two openings in the countertop. A first hollow cylindrical flexible polymeric sleeve is pushed over the hot water threaded inlet nipple. The sleeve has an inside diameter smaller than an outside diameter of the hot water threaded inlet nipple. The sleeve has an outside diameter larger than the hot water faucet opening in the countertop. Similarly, a second hollow cylindrical flexible polymeric sleeve is pushed over the cold water threaded inlet nipple and likewise has an inside diameter smaller than the outside diameter of the inlet nipple and an outside diameter larger than the inside diameter of the opening in the countertop. The flexible hoses are then secured to the bottom of the nipples and the assembly is then pushed through the hot and cold water openings in the countertop until the assembly abuts the upper surface of the countertop. This secures a faucet assembly onto the countertop without the necessity of screwing a nut on hot and cold water inlet threaded nipples below the countertop.

BRIEF DESCRIPTION OF DRAWINGS

FIG. 1 is a perspective view of a faucet assembly used in the method of the present invention.

FIG. 2 is a perspective view of a countertop with flexible hoses extending there through.

FIG. 3 is a perspective view of the underside of the faucet assembly in FIG. 1.

DESCRIPTION OF THE PREFERRED EMBODIMENT

Figures 1, 2, 3:
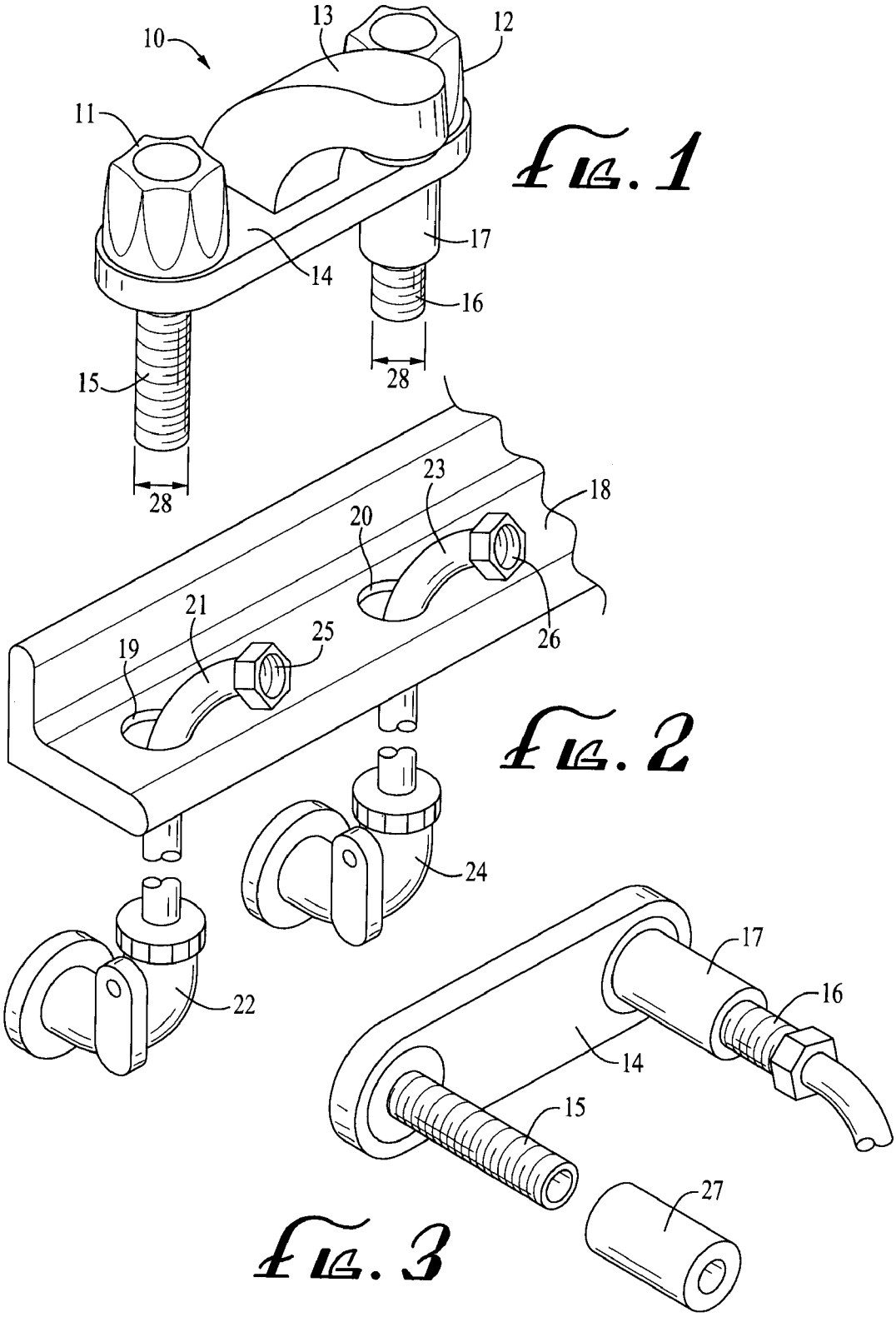

A faucet assembly 10 is shown in FIG. 1 and has a hot water faucet handle 11 and a cold water faucet handle 12 and a spigot 13. Faucet base 14 supports a downwardly depending hot water inlet nipple 15 and cold water inlet nipple 16. A hollow cylindrical flexible pulmonaric sleeve 17 is shown pressed over the inlet nipple 16.

Figure 4:
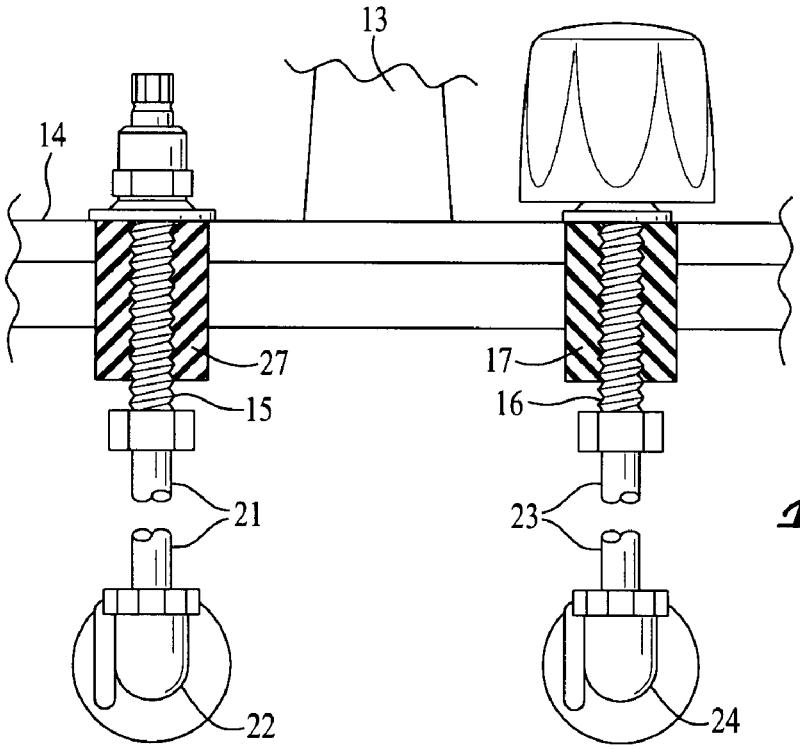
FIG. 4 is a cross sectional view of the faucet assembly secured to the countertop.

FIG. 2 shows a countertop 18 with a hot water faucet opening 19 and a cold water faucet opening 20 formed there through. A flexible hot water hose 21 is affixed at its lower end to hot water under sink inlet valve 22. Similarly, flexible hose 23 is affixed at its' lower end to cold water under sink inlet valve 24. The upper end 25 of hose 21 extends through opening 19. Similarly, upper end 26 of hose 23 extends through opening 20. A first polymeric sleeve 27 and a second polymeric sleeve 17 both are pressed over the inlet nipples as indicated in FIG. 3 and a cross sectional view of the faucet assembly secured to the countertop is shown in FIG. 4. The inside diameters of the sleeves 17 and 27 are preferably about 1/16 inches smaller than the outside diameters 28 of the inlet nipples so that sleeves are securely held on the nipples. The sleeves are preferably flexible polymeric sleeves. Neoprene rubber having a Shore A hardness of about 60 has been found useful for the practice of the present invention. The length of the polymeric sleeves are preferably longer than the thickness of the countertop so that they extend below the under surface of the countertop and expand slightly below the surface to hold the assembly securely in place.

After the sleeves have been pressed in place, the upper hose ends 25 and 26 are secured to the lower ends of nipples 15 and 16. Next, the assembly is pressed through openings 19 and 20 until the under surface of faucet base 14 abuts the upper surface of countertop 18.

In this way the faucet assembly is securely affixed to the countertop without the necessity of reaching under the countertop to screw a nut onto the hot and cold water downwardly depending nipples. The sleeves are inexpensive to fabricate and take almost no time to install.

Figure 5:
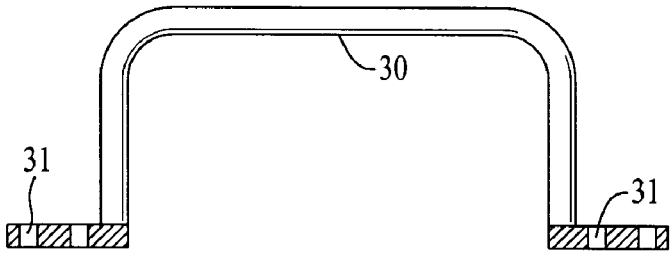
FIG. 5 is a side view partly in cross section of a removal tool.

A removal tool 30 is shown in FIG. 5. It has a pair of openings 31 which may be placed over the hot and cold water valve ends after the handles have been removed. Then the assembly may be lifted up from the countertop. This facilitates the removal and replacement or repair of the faucet assembly when necessary.

I claim:

1. A method for securing a faucet assembly to a countertop, the faucet assembly having a faucet base supporting a hot and a cold water faucet valve and a spigot and the hot water faucet valve having a downwardly depending hot water threaded inlet nipple and said cold water faucet having a downwardly depending cold water threaded inlet nipple and said countertop having a hot water faucet opening and a cold water faucet opening and the countertop being supported above a hot and a cold water under-sink inlet valve with a hot and a cold water threaded outlet, the method comprising:

securing a lower end of a flexible hot water hose to the hot water threaded outlet of the hot water under-sink valve and securing a lower end of a flexible cold water hose to the cold water threaded outlet of the cold water under-sink valve;

passing an upper end of the flexible hot water hose through said hot water faucet opening and passing an upper end of the flexible cold water hose through said cold water faucet opening, each of said upper ends of said flexible hoses having an outlet nut;

pushing a first hollow, cylindrical, flexible polymeric sleeve over the hot water threaded inlet nipple, said hollow, cylindrical, flexible polymeric sleeve having an inside diameter smaller than an outside diameter of said hot water threaded inlet nipple yet large enough to be pushed over the hot water inlet nipple and an outside diameter larger than the hot water faucet opening and yet small enough to be pushed through the hot water faucet opening;

pushing a second hollow, cylindrical, flexible polymeric sleeve over the cold water threaded inlet nipple, said second hollow, cylindrical, flexible polymeric sleeve having an inside diameter smaller than an outside diameter of said cold water threaded inlet nipple yet large enough to be pushed over the cold water inlet nipple and an outside diameter larger than the cold water faucet opening and yet small enough to be pushed through the cold water faucet opening;

securing an upper end of said flexible hot water hose to the downwardly depending hot water threaded inlet nipple of the hot water faucet and securing an upper end of said flexible cold water hose to the downwardly depending cold water threaded inlet nipple of the cold water faucet; and pushing the thusly affixed flexible polymeric sleeves through the hot and cold water faucet openings in said countertop until the faucet assembly abuts an upper surface of said countertop thereby securing the faucet assembly to the countertop without the necessity of screwing a nut on the hot and cold water threaded inlet nipples below the countertop.

2. The method of claim 1 wherein said first and second polymeric sleeves have a Shore A hardness of about 60.

3. The method of claim 1 wherein said first and second polymeric sleeves have an inside diameter about 1/16 inches smaller than the outside diameter of said inlet nipples.

4. The method of claim 1 wherein said first and second polymeric sleeves have an outside diameter about 1/16 inches larger than the inside diameter of said hot and cold water faucet openings of said countertop.

5. The method of claim 1 wherein the length of said polymeric sleeves is greater than a thickness of said countertop at the water faucet openings.

6. The method of claim 1 wherein said polymeric sleeve is fabricated from neoprene.

* * * * *